US005294043A

United States Patent [19]

Platt

[11] Patent Number: 5,294,043

[45] Date of Patent: Mar. 15, 1994

[54] PRODUCT CARTON

[75] Inventor: Ronald G. Platt, Harvard, Ill.

[73] Assignee: The Packaging House, Inc., Chicago, Ill.

[21] Appl. No.: 835,762

[22] Filed: Feb. 13, 1992

[51] Int. Cl.[5] ..... B65D 5/28

[52] U.S. Cl. ..... 229/143; 229/103; 229/128

[58] Field of Search ..... 229/101, 103, 128, 117.07, 229/141, 142, 143, 154

[56] References Cited

U.S. PATENT DOCUMENTS

| | | | |
|---|---|---|---|
| 2,251,565 | 8/1941 | Forman | 229/103 |
| 2,316,701 | 4/1943 | Marshall | 229/117.07 |
| 2,980,310 | 4/1961 | Arneson | 229/117.07 |
| 3,886,901 | 6/1975 | Zeitter | 229/221 |
| 4,206,868 | 6/1980 | Stephens | 229/103 |
| 4,306,658 | 12/1981 | Montealegre | 229/103 |
| 4,340,169 | 7/1982 | Webinger | 229/103 |
| 4,452,367 | 6/1984 | Wein | 229/103 |
| 4,628,863 | 12/1986 | Eichenauer | 229/140 |
| 4,702,409 | 10/1987 | Osbourne | 229/117.07 |
| 4,807,563 | 2/1989 | Berry et al. | 229/101 |
| 5,060,849 | 10/1991 | King | 229/103 |
| 5,062,527 | 11/1991 | Westerman | 229/117.06 |
| 5,115,524 | 5/1992 | Ankosko | 229/103 |

*Primary Examiner*—Allan N. Shoap
*Assistant Examiner*—Christopher McDonald
*Attorney, Agent, or Firm*—Jones, Day, Reavis & Pogue

[57] ABSTRACT

A paperboard panel having score lines thereon such that it can be folded to form a 4-point glued infold tray to contain product, can be folded flat for storage purposes or can receive product and be further folded to form a closed box-like structure totally enclosing the product and having a self-locking feature to keep the box in its closed position.

3 Claims, 11 Drawing Sheets

PRODUCT CARTON

FIELD OF THE INVENTION

The present invention relates in general to cartons and in particular to a carton made of a paperboard blank having score lines thereon which enable the carton to be folded substantially flat for storage, erected to form a tray having a bottom panel and vertical and end side walls to receive a product and further folded to form a box-like structure that totally encloses the product in a self-locking condition.

BACKGROUND OF THE INVENTION

There are many and varied types of product cartons in the prior art. Some of them can be folded into a flat state and erected to form a tray for receiving a product such as food products. Others can be folded in a flat state for storage and then erected to form a closed container for holding a product.

In the fast food industry especially, a package is required which can be easily opened, filled with the product, closed and then reopened to gain access to the product and to reclose it if desired. Such prior art packages for the fast food industry are generally of styrofoam or similar material which can be stacked one within the other for storage purposes. When used, the food products are placed in a bowl-shaped depression on one side of the package and the other side is folded about a hinge and locked to the bottom portion with a tab in a slot. This container can of course be opened and closed repeatedly. However, if the containers are to be used in a location with restricted space, such as on an airplane, the bowl-shaped containers, even though they stack within each other, require a significant amount of space. Further, the prior art containers require a closure of some type, generally a slot with a projection that is inserted in the slot to lock the two halves together.

The present invention provides a carton that is formed from a paperboard blank and which can be first folded in a substantially flat state for storage, unfolded, second, to form a tray with a bottom wall and vertical side walls and end walls for receiving the product and can be further folded, third, to form a box-like structure that encloses the product totally. The scoring of the carton allows it to fold and close easily. Further, unique diagonal score lines on the side walls allow the carton, when folded to the box-like structure, to fold its side walls around and over the product, thus holding the product securely in the container. In addition, this unique diagonal scoring on the side walls interacts against and with the product to result in a resilient, self-locking closure that does not require special locks or locking devices. Further, when opened from the box-like structure to the tray, space is provided on each side of the center portion of the tray where the product is located to allow additional product such as french fries to be placed therein. The blank can also be formed such that it can be pre-setup by machine although in such case, the tray cannot be folded to a flat state from its erected state. Also, the blank can be formed such that, when erected into a rectangular tray, a plurality of the rectangular trays can be nested within each other to conserve space.

Thus the present invention relates to a product carton that can be folded to a substantially flat state for storage, erected as a tray having a bottom wall, vertical side walls and end walls for receiving a product, and further folded to form a box-like structure that totally encloses the product.

It is an important object of the present invention to provide a carton that utilizes score lines on the side wall panels to cause an interaction between the side wall panels and the product which results in a self-locking box-like structure.

It is another important object of the present invention to provide a product carton which has a plurality of spaced inverted V-shaped score lines on each side wall panel to cause the side wall panels to fold around and over the product, thus holding it securely in place in the container.

It is yet another object of the present invention to provide a product carton that can be pre-setup by machine but cannot be folded to a flat state.

It is also another object of the present invention to provide a product carton that, when erected to form a substantially rectangular tray, can be nested one within the other for purposes of conserving space.

SUMMARY OF THE INVENTION

Thus the present invention relates to a product carton comprising a paperboard panel having sections hingedly connected by first score lines allowing the carton to be folded to a flat state for storage and unfolded to form a 4-point glued infold tray of rectangular shape with a bottom wall, vertical end walls and vertical side walls for receiving a product and second score lines in the vertical side wall sections for enabling the tray to be further folded to form a self-locking box-like structure for totally enclosing a product, the box-like structure remaining closed by interaction of the side wall sections with a product and being capable of being unfolded to re-form the tray and expose the product.

BRIEF DESCRIPTION OF THE DRAWINGS

These and other objects of the present invention will be more fully understood in conjunction with the accompanying drawings in which like numbers indicate like components and in which.

DETAILED DESCRIPTION OF THE DRAWINGS

Figure 1:
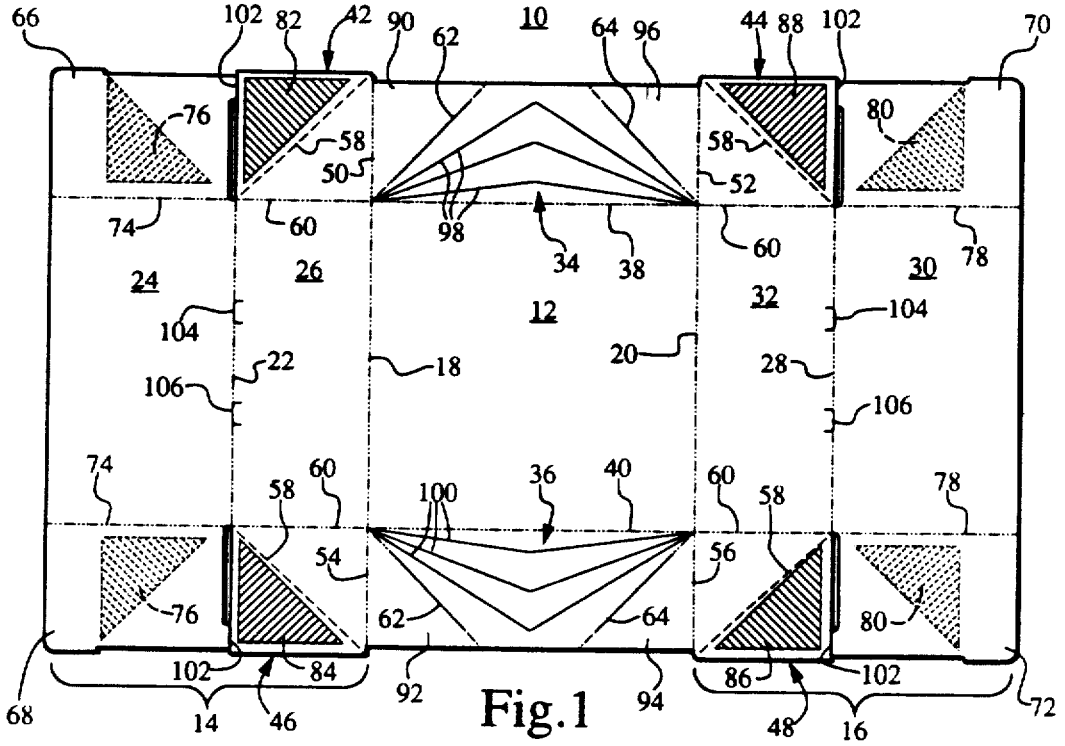
FIG. 1 is the plan view of the blank from which the novel carton can be formed.
Figure 2:
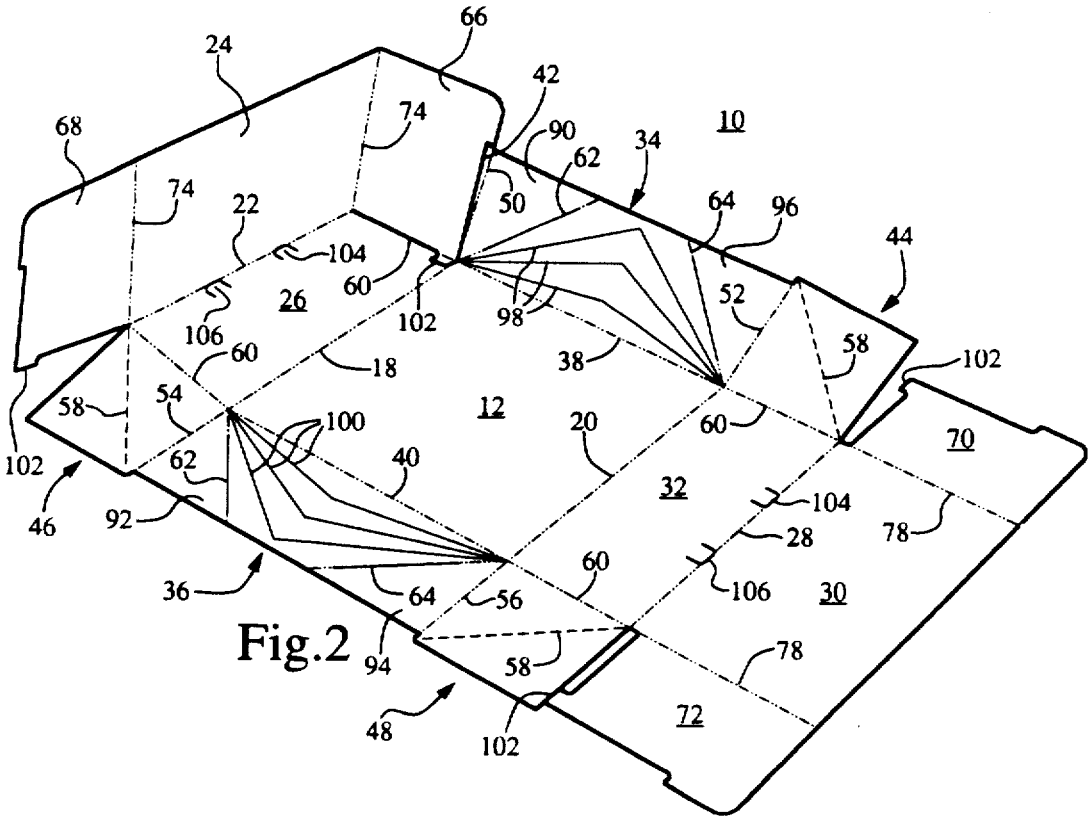
FIG. 2 is an isometric view illustrating the carton being folded at one end thereof.

FIG. 1 is a plan view of the novel paperboard panel blank which has sections hingedly connected by a first set of score lines allowing the carton to be glued and folded to a flat state for storage, unfolded to form a 4-point glued infold tray of rectangular shape with a bottom wall, vertical end walls and vertical side walls for receiving a product and a second set of score lines in the vertical side wall sections for enabling the tray to be further folded to form a self-locking box-like structure for totally enclosing a product, the box remaining closed by interaction of the side wall sections with a product and being capable of being unfolded to form the tray and expose the product. The blank 10 comprises a rectangular bottom center panel 12 having sides and ends. A rectangular end panel, 14 and 16, is integrally formed on each end of the center panel 12 and hingedly connected to the center panel 12 by first score lines 18 and 20, respectively. Second score lines, 22 and 28 respectively, separate the end panels 14 and 16 into outer sections 24 and 30, respectively, and inner sections 26 and 32, respectively. A continuous side wall includes center wall sections 34 and 36, respectively, and end flaps 42 and 44 and 46 and 48, respectively. The center wall sections 34 and 36 are hingedly connected to each side of the center panel 12 with third score lines 38 and 40, respectively. The end flaps 42, 44, 46 and 48 are connected to the inner sections 26 and 32, respectively, by the hinge lines 60.

A side flap, 66, 68, 70 and 72, is hingedly connected to each side of each outer section 24 and 30, respectively, of each end panel 14 and 16, respectively, by fourth score lines, 74 and 78 respectively, such that when each of the outer sections 24 and 30 is folded upwardly about the respective score lines 22 and 28 and their side flaps 66, 68 and 70, 72 are folded inwardly about score lines 74 and 76, respectively, and the continuous side walls 34 and 36, respectively, and the end flaps 42, 44, 46 and 48 are respectively folded upwardly about their respective hinge connections 38, 40 and 60 to their vertical positions, a rectangular tray is formed with a bottom wall 12, side walls 38 and 40 and end walls 24 and 30. Glue is placed on one portion, 76 and 80, of each of the side flaps 66, 68, 70 and 72 such that the side flaps may be folded inward and glued to the insides 82, 84, 86 and 88, respectively, of each vertical end flap 42, 44, 46 and 48 to form the 4-point glued infold tray that will hold a product.

Figure 4:
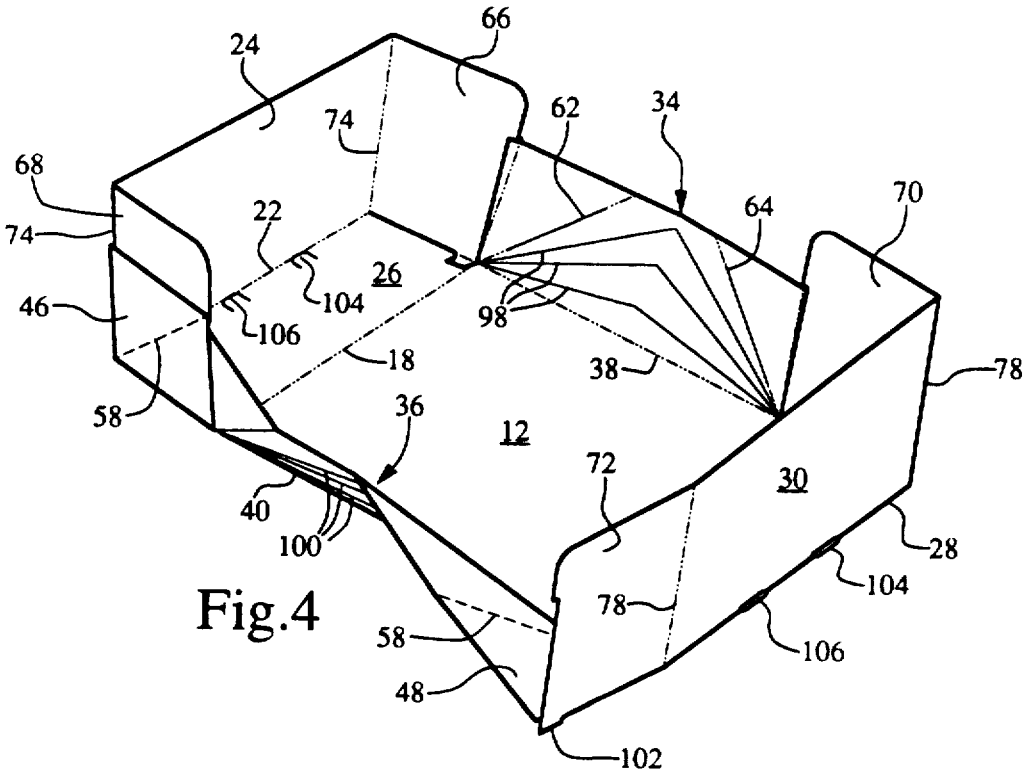
FIG. 4 is an isometric view of the novel blank being folded to the complete tray except for one corner thereof.
Figure 5:
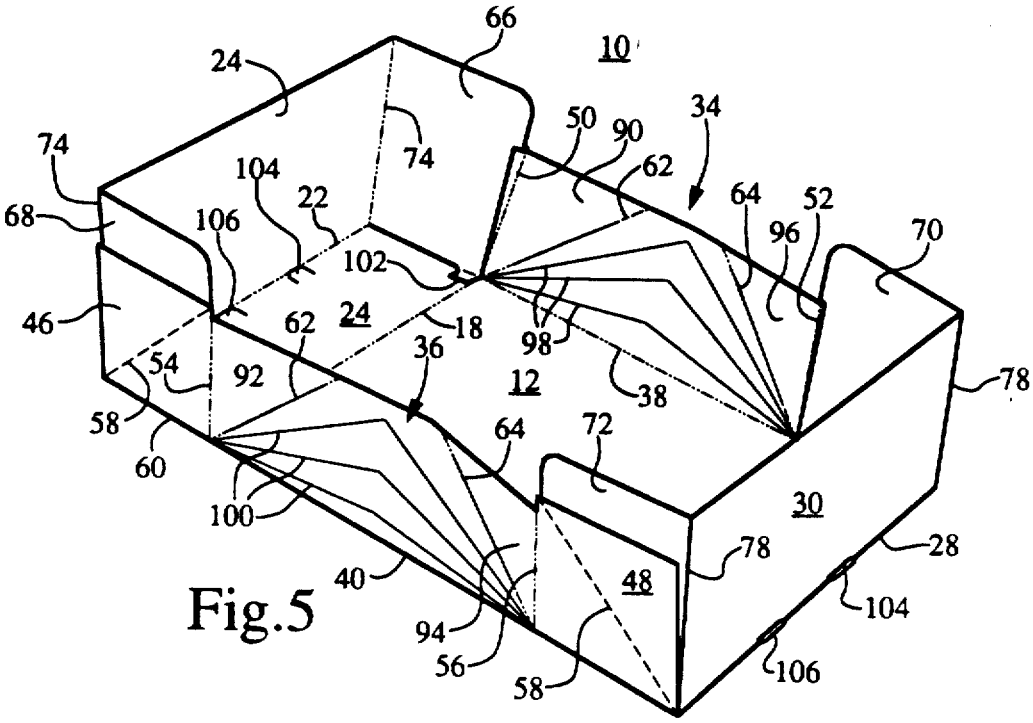
FIG. 5 is an isometric view of the carton blank having been erected to form a rectangular tray having a bottom and vertical side walls and end walls.
Figure 6:
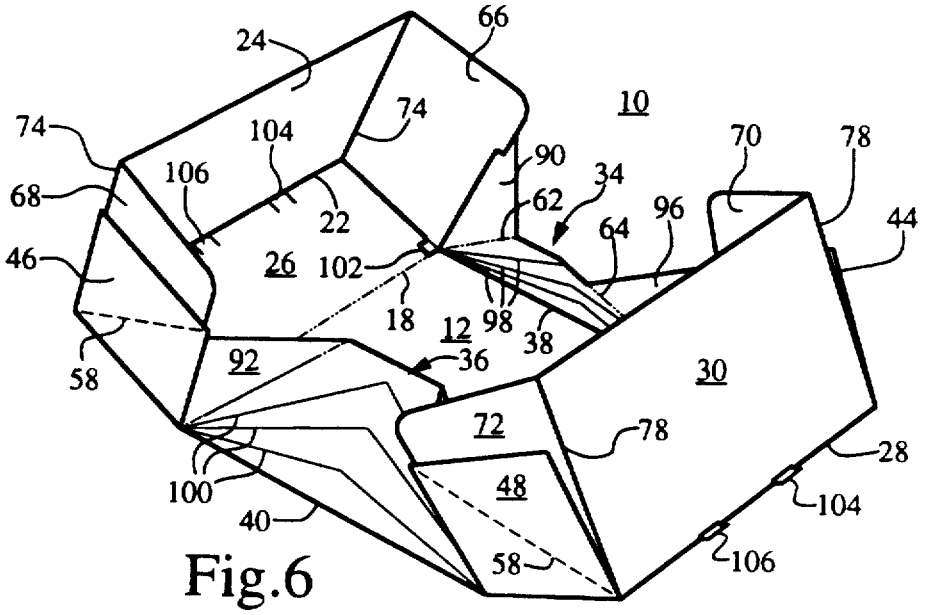
FIG. 6 is an isometric view of the tray of FIG. 5 being further folded to form an enclosed box or carton.
Figures 24, 25, 26, 27:
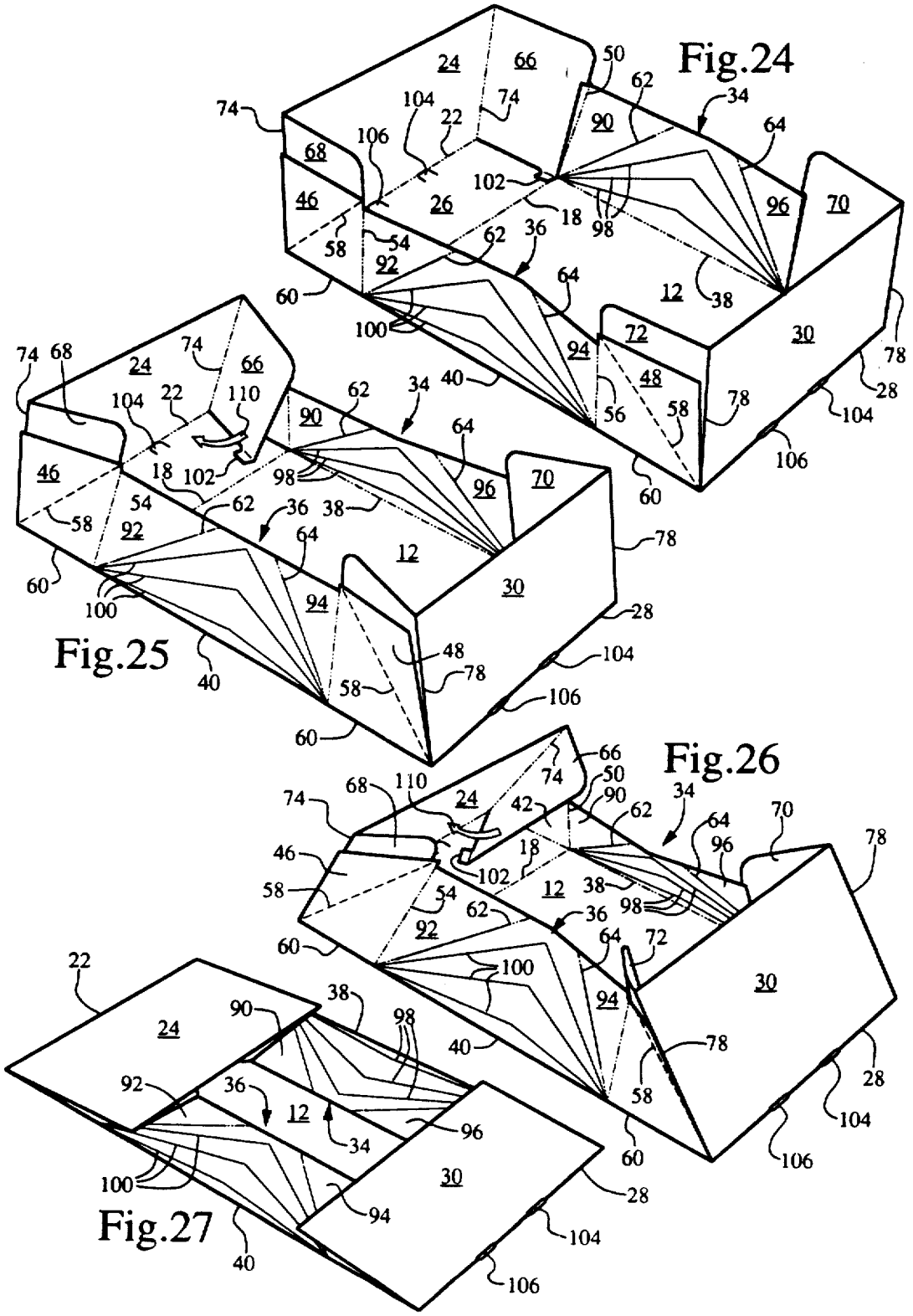
FIG. 24, FIG. 25 and FIG. 26 illustrate the process of folding the tray of FIG. 5 to its flat state.
FIG. 27 is an isometric view of the novel carton in its flat state for storage purposes.

End flaps 42, 44, 46 and 48 are connected respectively to the outer ends of each side wall 34, 36 with a fifth score line 50, 52, 54 and 56, respectively. As can be more clearly seen in FIGS. 2–5, each end flap 42, 44, 46 and 48 overlaps a respective one of said side flaps 66, 68, 70 and 72. A diagonal score line 58 is placed on each of the end flaps 42, 44, 46 and 48 that extends upwardly and inwardly from each corner of the tray as best illustrated in FIG. 5. The glue areas 76 and 80 on the respective side flaps 66, 68, 70 and 72 are between the respective side flaps 66, 68, 70 and 72 and the corresponding portions 82, 84, 86 and 88 of the end flaps 42, 44, 46 and 48 above the diagonal score line 58. This is important when folding the erected tray to the flat state as shown in FIG. 27 as will be shown hereafter.

Figure 3:
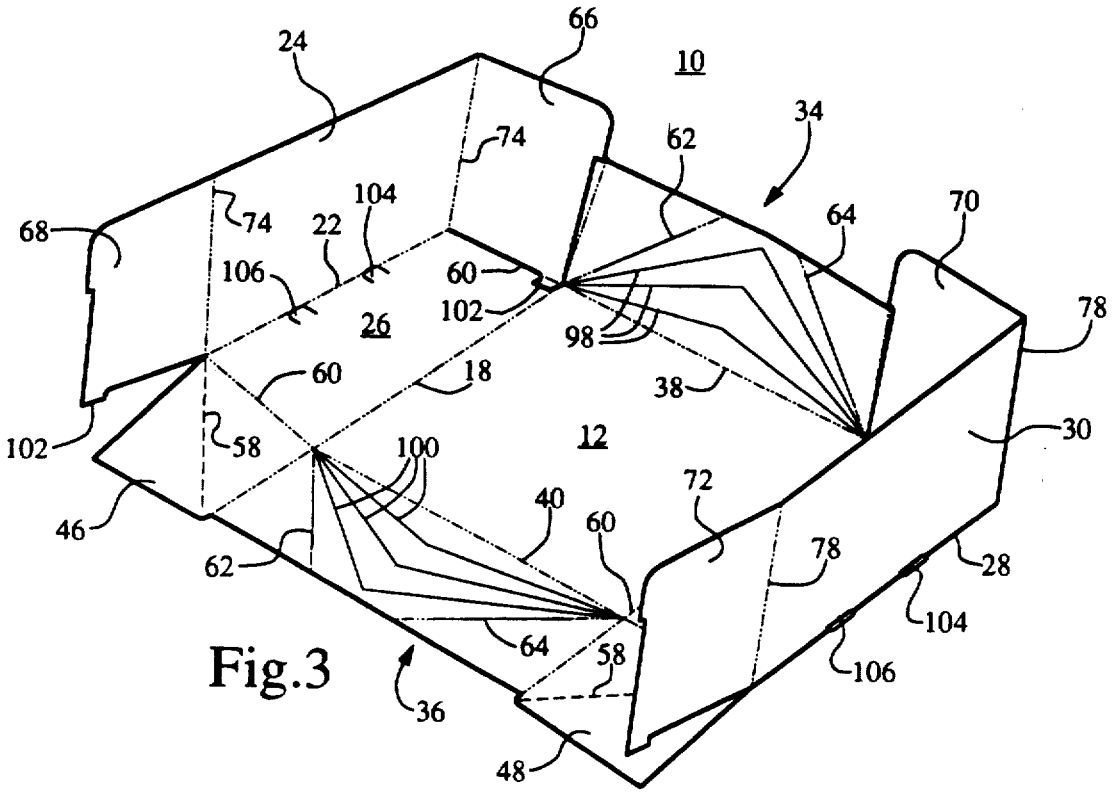
FIG. 3 is an isometric view illustrating the carton blank having three sides thereof folded to form a tray in the completely erected state.

Notice in FIG. 3 that the side flaps 68 and 72 will be folded inwardly about their respective score lines 74 and 78 and then the central wall portion 36 and end flaps 46 and 48 will be raised to the vertical position about their respective score lines 40 and 60. The glue on the side flaps 68 and 72 will then cause the end flaps 46 and 48 to be attached thereto to form the tray illustrated in FIG. 5. FIG. 4 illustrates the tray in its erected state except for the one corner where side flap 72 has not been folded inwardly about its respective score line 78 and end flap 48 has not been folded upwardly on the outside of side flap 72 as shown in its final state in FIG. 5.

Figure 7:
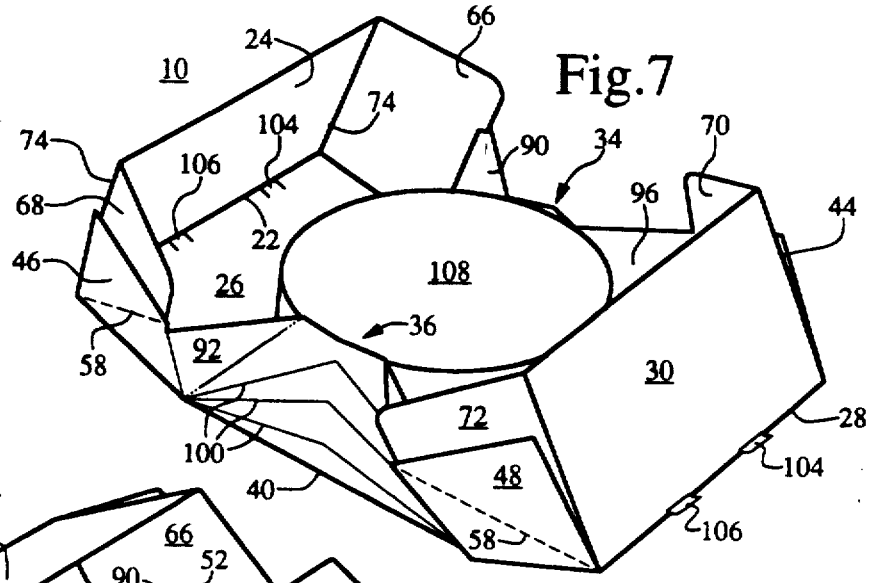
FIG. 7 is an isometric illustration of the tray of FIG. 5 being folded with a product therein to form the enclosed box or carton.
Figure 8:
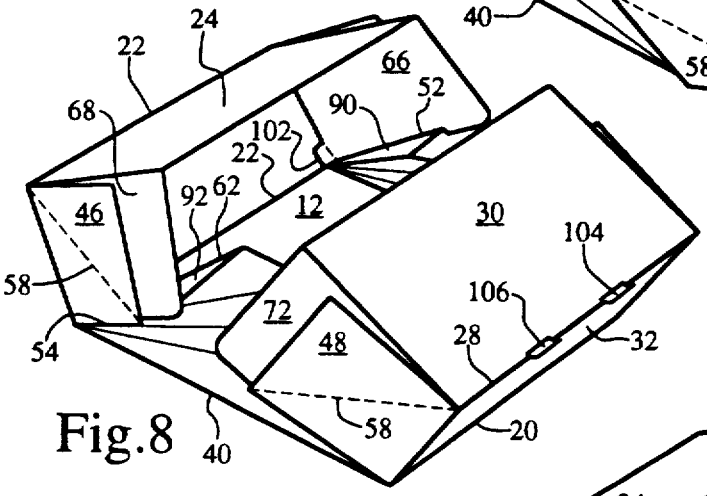
FIG. 8 is an isometric view of the last stages of folding the empty tray into an enclosed box or carton.
Figure 9:
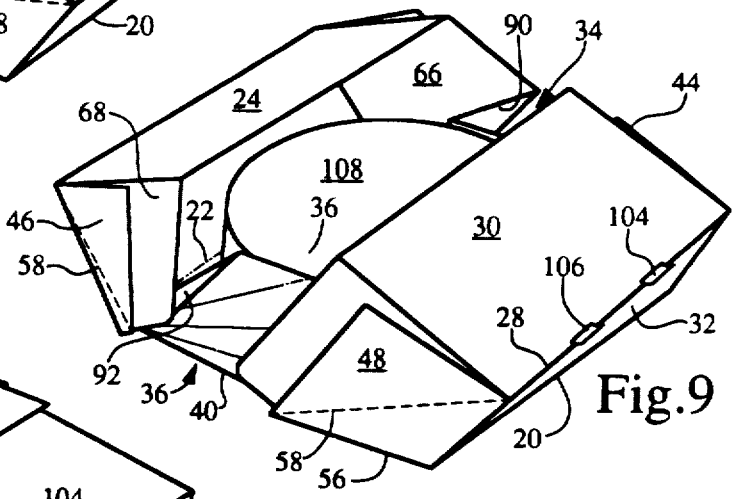
FIG. 9 is an isometric view of the tray being folded to its nearly enclosed state with a product therein.
Figure 10:
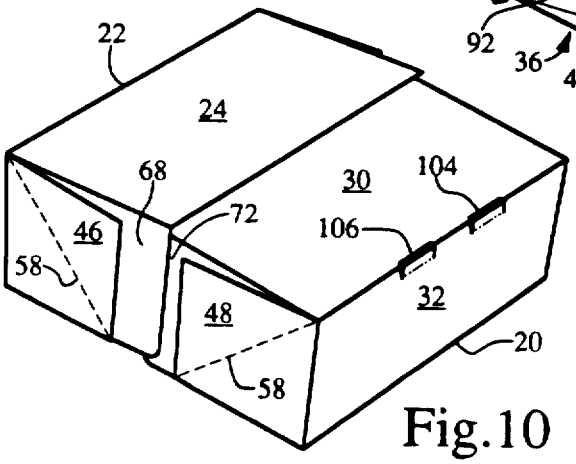
FIG. 10 is an isometric view of the completely folded and enclosed box or carton.

When it is desired to fold the 4-point glued infold tray in FIG. 5 to a box for enclosing a product, the tray is folded as illustrated in the perspective view in FIGS. 6, 7, 8, 9 and 10. In FIGS. 7 and 9 a product is shown in the box being folded, while in FIGS. 6 and 8 there is no product. Thus, as can be seen in FIGS. 5–10, the end flaps 42, 44, 46 and 48 are hingedly connected by fifth score lines 50, 52, 54 and 56, respectively, to and form outer ends on the center side walls 34 and 36, respectively. These flaps 42, 44, 46 and 48 are also hingedly connected to a sixth score line 60 to the sides of the inner sections 26 and 32, respectively, of the end panels. Each end flap 42, 44, 46 and 48 overlaps and is glued to the outside of a corresponding one of the side flaps 66, 68, 70 and 72, as explained earlier, to form the tray with the vertical end walls and vertical side walls. A first diagonal score line 62 is formed on one end of each of the center side walls 34 and 36 and extends upwardly and inwardly from the junction of the first score line 18 and the third score line 38 to the top of the side wall 34 and 36. A second diagonal score line 64 is formed on the other end of each of the side walls 34 and 36 and extends upwardly and inwardly from the junction of the first score line 20 and the third score line 38 to the top of each of the side walls 34 and 36 such that each folded rectangular end panel 14 and 16 (shown in FIG. 1) may be folded inwardly about their respective score lines 18 and 20 to allow the outer sections 24 and 30, respectively, of the end panels 14 and 16 to overlap each other and form a box-like structure for enclosing the product as illustrated in FIG. 10.

Figure 11:
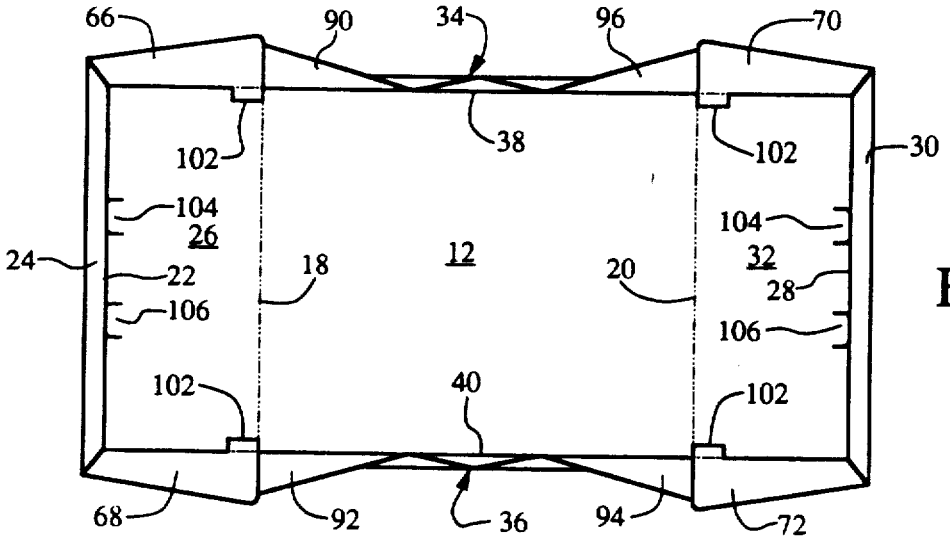
FIG. 11 is a top view of the tray of FIG. 5 in its open condition as a tray.
Figure 12:
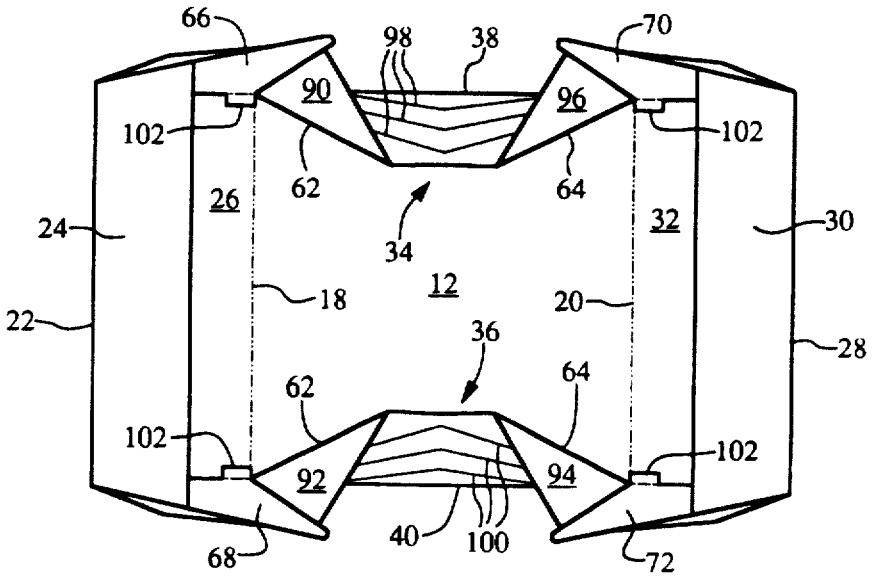
FIG. 12 is a top view of the tray of FIG. 11 partially folded towards the enclosed box or carton state.
Figure 13:
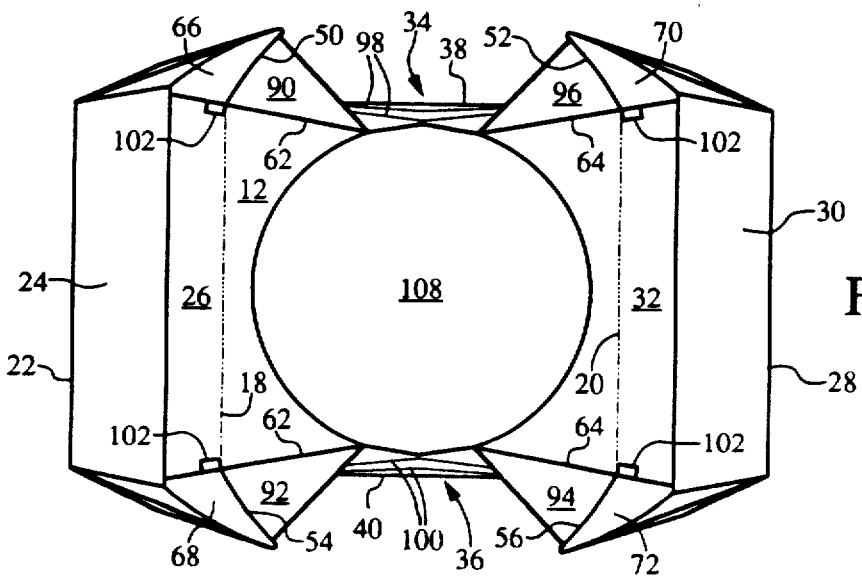
FIG. 13 is a top view of the tray of FIG. 11 being partially folded towards an enclosed state with a product therein.
Figure 14:
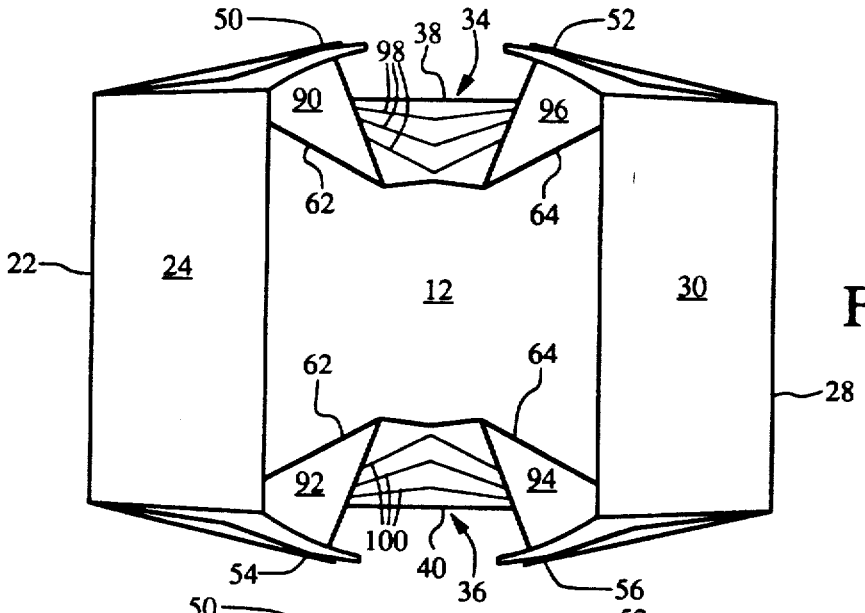
FIG. 14 is a top view of the tray of FIG. 11 as it approaches the completely folded box state.
Figure 15:
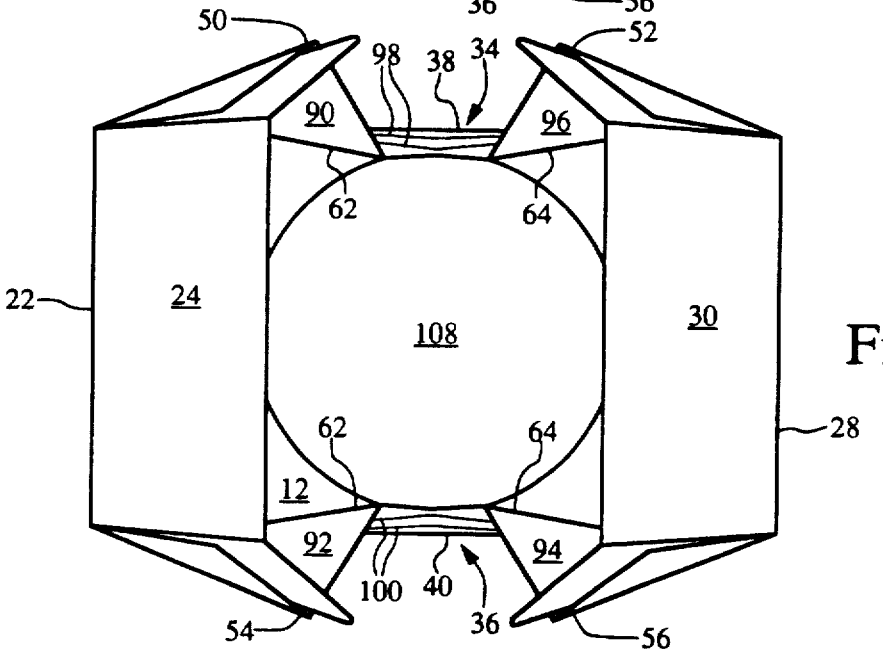
FIG. 15 is similar to FIG. 14 except there is a product enclosed within the carton.
Figure 16:
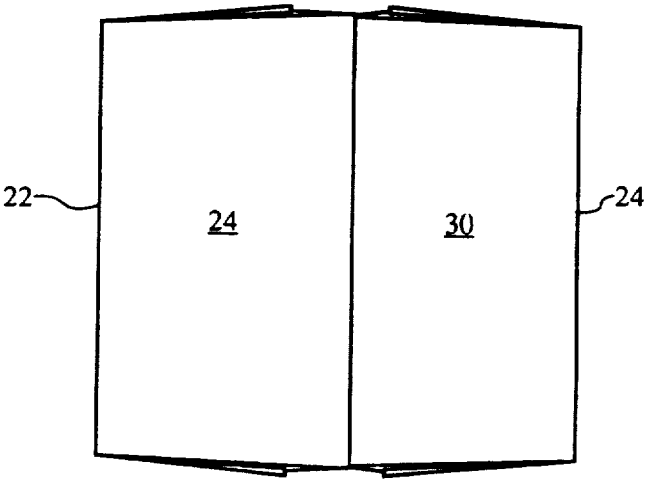
FIG. 16 is a top view of the enclosed carton.

FIGS. 11-16 are top views of the same process, starting with the 4-point glued infold tray shown in FIG. 11 to the closed box illustrated in FIG. 16. Note that with product positioned on bottom wall 12, as shown in FIG. 13, the tray can be formed as shown in FIG. 11 and other products, such as bags of French fries can be placed on inner section 26 and 32 on each side of the product 108. Note that in FIG. 13 and in FIG. 15, with product 108 in the tray as it is being folded, the center side walls 34 and 36 do not move as far inwardly as they do in FIGS. 12 and 14. This is an important feature to form the self-locking carton, as will be explained hereafter.

Figure 21:
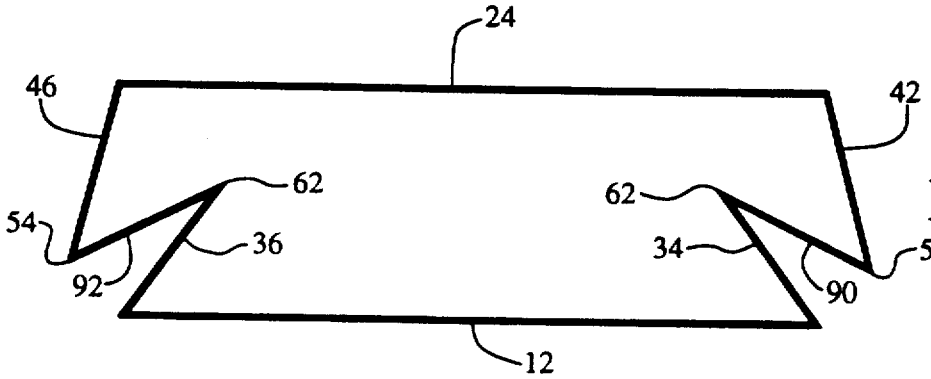
FIG. 21 is a cross-sectional view of a carton as in FIG. 19 just before its completely closed state illustrating the wide angle between the closing side flaps which tend to force the carton to its open position.
Figure 22:
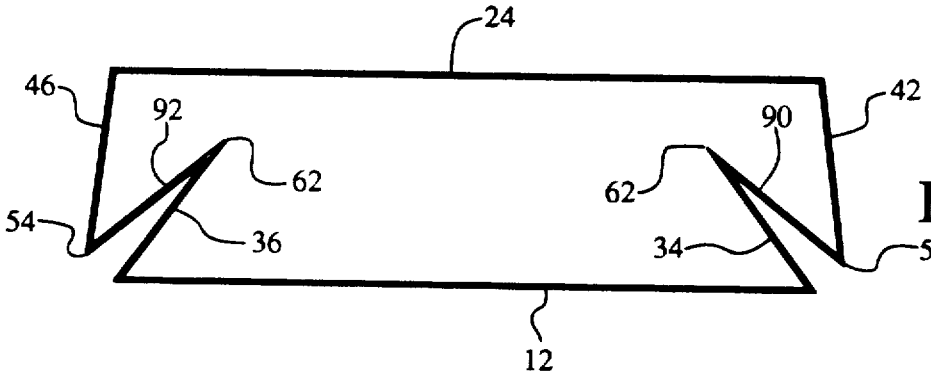
FIG. 22 is a cross-sectional view of a closed carton without any product illustrating again the tendency of the carton to open itself.
Figure 23:
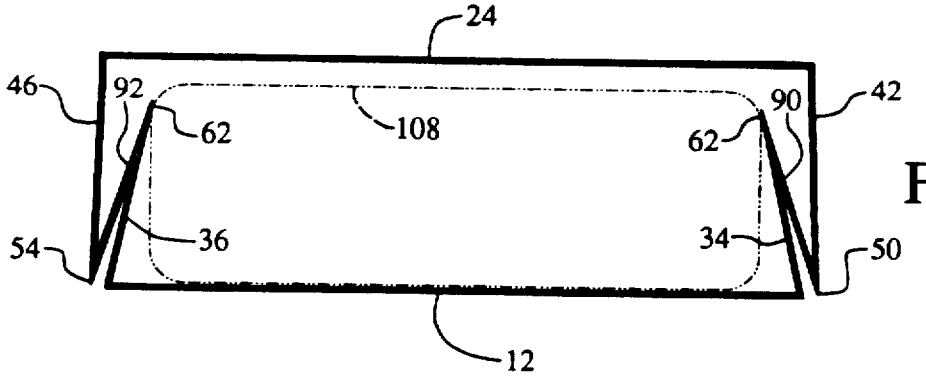
FIG. 23 is a cross-sectional view of a carton with product therein illustrating how the product interacts with the closure flaps to provide a self-locking carton that maintains itself in the closed position with the product.

Note in FIGS. 11-15 that triangular panel 90, 92, 94 and 96 are formed by the first diagonal score lines 62 and 64 and the corresponding fifth score lines 50, 52, 54 and 56 at each end of each central side wall 34 and 36. Thus, triangular panels 90, 92, 94 and 96 are hingedly connected to the center panel 12 and to the end flaps 42, 44, 46 and 48. The triangular panels 90, 92, 94 and 96 are folded inwardly between the side flaps 66, 68, 70 and 72 and the central side walls 34 and 36 when each rectangular end panel 14 and 16 is folded inwardly about the first score lines 18 and 20 and the side walls 34 and 36 fold upwardly about the third score lines 38 and 40 such that a closed box-like structure is formed. Pressure against the central side walls 34 and 36 by the product 108 in the box-like structure as shown in FIG. 13 and FIG. 15 forces the triangular panels 90, 92, 94 and 96 toward their folded position, thus providing a box-like structure that self-locks in the closed position. This can be seen more clearly in FIGS. 21, 22 and 23, which are cross-sectional views of the box-like structure in FIGS. 8 and 10. In FIG. 21, the carton is not completely closed and it will be noted that the side flaps 90 and 92 and the side walls 34 and 36 are separated by a rather large angle, thus tending to open the partially closed box (as shown in FIG. 8) toward the position shown in FIG. 6. FIG. 22 illustrates a cross-sectional view of the carton in its completely closed condition with no product. Note again that the fold lines 62 are well inside the carton and that the angle between side walls 34 and 36 and the bottom panel 12 is approximately 45°. Again, this tends to open the carton. However, note in FIG. 23 that with product 108 in the carton, the score lines 62 are forced upwardly close to the end flaps 42 and 46. That pulls the score lines 50 and 54 inwardly toward the bottom panel 12. Thus the carton is forced to its closed position and held in that position by the product 108 within the carton. This feature enables the carton to have its own self-locking feature when product is placed within the carton.

It will be noted in FIGS. 13 and 15 that when product is placed in the carton and the carton is being folded toward its closed state, that the side walls 34 and 36 can fold around and over the product because of the score lines 98 and 100. Thus a plurality of spaced inverted V-shaped score lines 98 and 100, respectively, in each of the respective side walls 34 and 36 between the triangular panels 90 and 96 in side wall 34 and 92 and 94 in side wall 36 allow the central side walls 34 and 36 to fold around and over the product 108 in the box-like structure. This not only secures the product, but also brings an interaction between the product and the side wall panels 34 and 36 to bring about the self-locking condition as explained previously.

Figure 17:
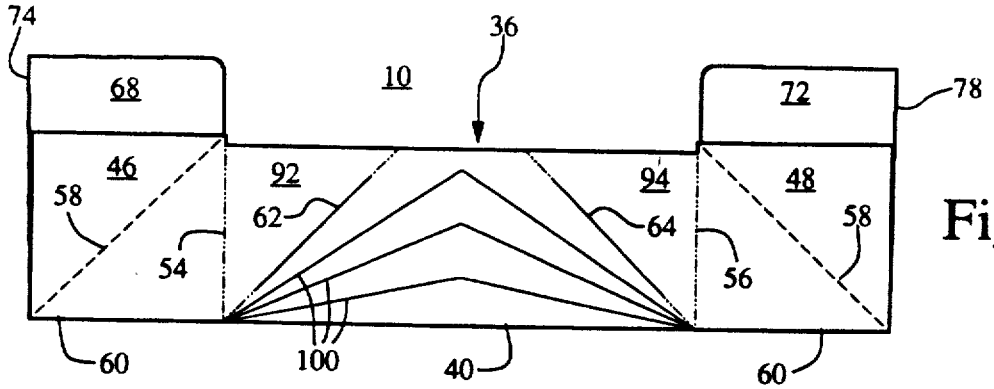
FIG. 17 is a side view of the tray of FIG. 5 in its completely erected state.
Figure 18:
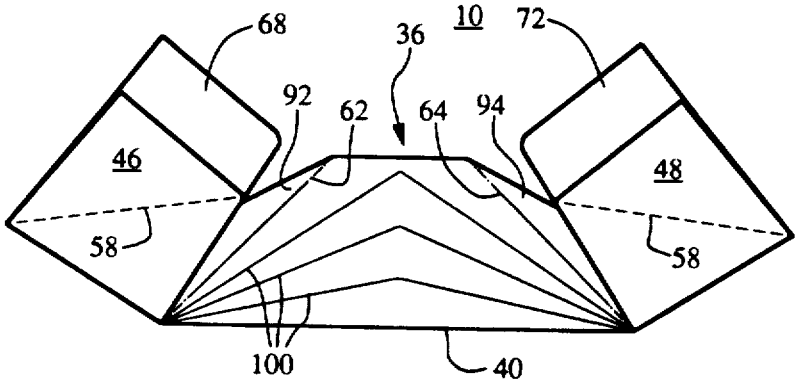
FIG. 18 is a side view illustrating the partial closure of the tray of FIG. 17 being folded to form the enclosed box or carton.
Figure 19:
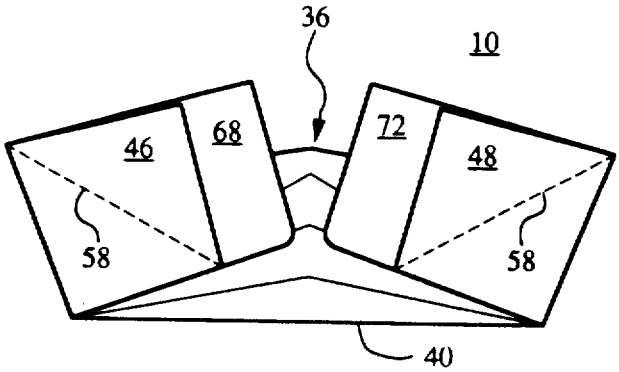
FIG. 19 is a side view illustrating the carton as it nears its completely folded state as an enclosed box or carton.
Figure 20:
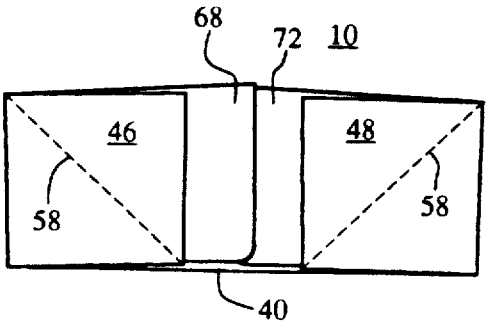
FIG. 20 is a side view of the completely folded enclosed carton or box.

It can be seen in FIGS. 15 and 17 that when the carton is folded to form the 4-part infold glued tray, the side flaps 66, 68, 70 and 72 extend above the central side walls 34 and 36 in height and are coterminous with the outer sections 24 and 30 of the end panels 14 and 16. When the box-like structure is formed as shown in FIGS. 10, 16 and 20, the outer end sections 24 and 30 and the side flaps 66, 68, 70 and 72 overlap each other to form the box-like structure. Thus in FIGS. 10, 16 and 20, end wall 24 overlaps end wall 30 and side flap 68 overlaps side flap 72.

When the end flaps 42, 44, 46 and 48 are folded inwardly about the first diagonal score line 58, the side flaps 66, 68, 70 and 72 of each of the end panels 14 and 16 are folded inwardly against the respective end walls 24 and 30 and the end walls 24 and 30 fold inwardly about the second score lines 22 and 28 to fold the carton to its flat state. This can be seen most clearly in FIGS. 24, 25, 26 and 27 where the side flaps 66, 68, 70 and 72 are folded inwardly as indicated by arrow 110 in relation to side flap 66 to illustrate that the side flaps 66, 68, 70 and 72 are moving toward their respective end walls 24 and 30 while the end flaps 46 are folding inwardly about score line 58. This can happen because the bottom portion of the side flaps 66, 68, 70 and 72 are not glued to the bottom portion of end flaps 42, 44, 46 and 48.

Thus as can be seen in FIG. 5 and FIG. 27, the blank in FIG. 1 can be erected to form the 4-point glued infold tray and can be folded flat as shown in FIG. 27 for storage and shipping purposes.

It will be noted in FIG. 1 and in FIGS. 24, 25 and 26 that a tab 102 extends downwardly from each inwardly folded side flap 66, 68, 70 and 72 to form a support for the vertically positioned side flaps 66, 68, 70 and 72. See FIGS. 11 and 24. Note also in FIG. 1 and FIGS. 24, 25 and 26 that two spaced slots 104 and 106 in each second score line 22 and 28 receive the tabs 102 at each end of the carton when it is in its folded condition as illustrated in FIG. 27.

Figure 28:
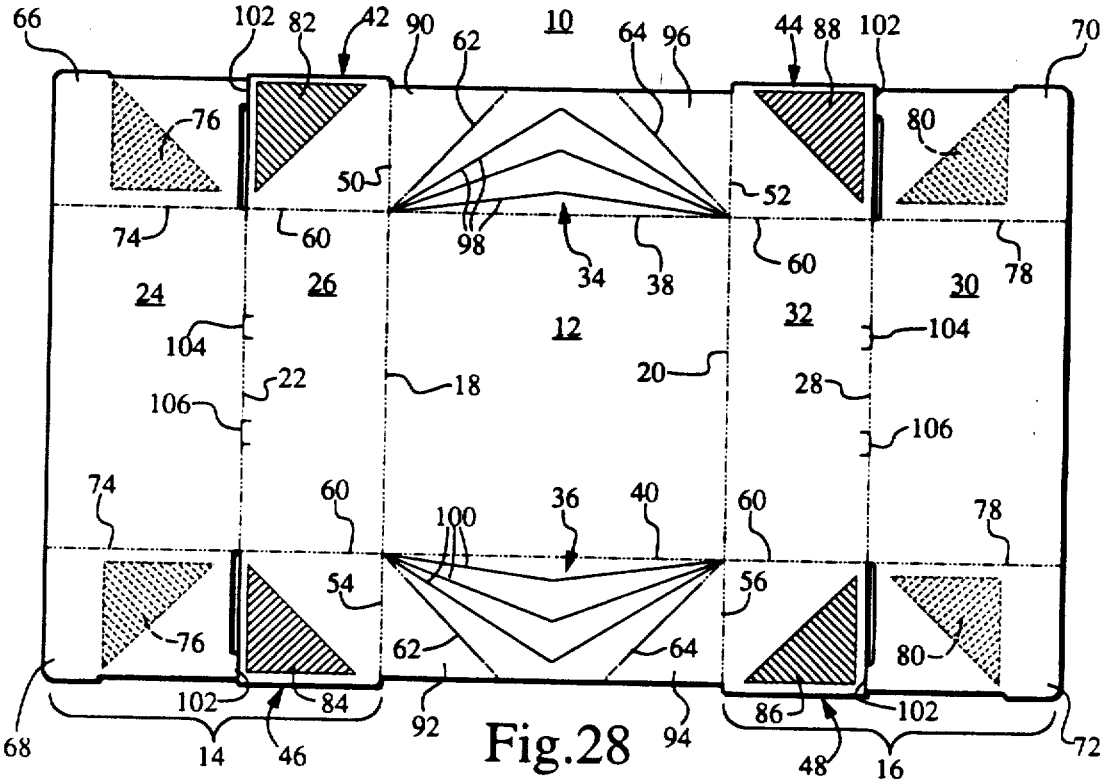
FIG. 28 is a plan view of a modified blank which enables the tray to be pre-setup by machine and which cannot be folded to the flat state.

It is important in some circumstances to provide a carton blank which can be pre-setup into a tray by a machine. Such trays, when erected, cannot be folded to the flat state. FIG. 28 illustrates a paperboard blank for forming such a carton. It will be noted that there is no score line in the vertical end flaps 42, 44, 46 and 48. It is these score lines such as shown in FIG. 1 by the dashed diagonal line 58, that allow the carton to be folded to its flat state from its state as a rectangular tray.

Figure 29:
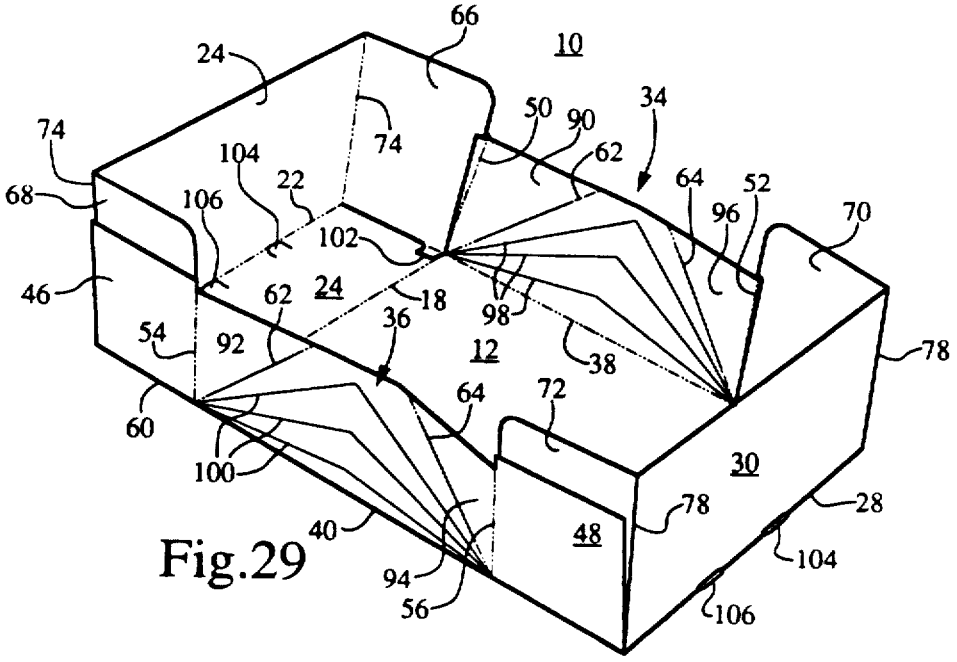
FIG. 29 is an isometric view of the carton blank of FIG. 28 after it has been erected to form a rectangular tray that cannot be folded to the flat position.

FIG. 29 illustrates the blank of FIG. 28 after it has been folded into a substantially rectangular tray by a machine in a pre-setup condition. Note again that there are no score lines in the end flaps 46 and 48.

Figure 30:
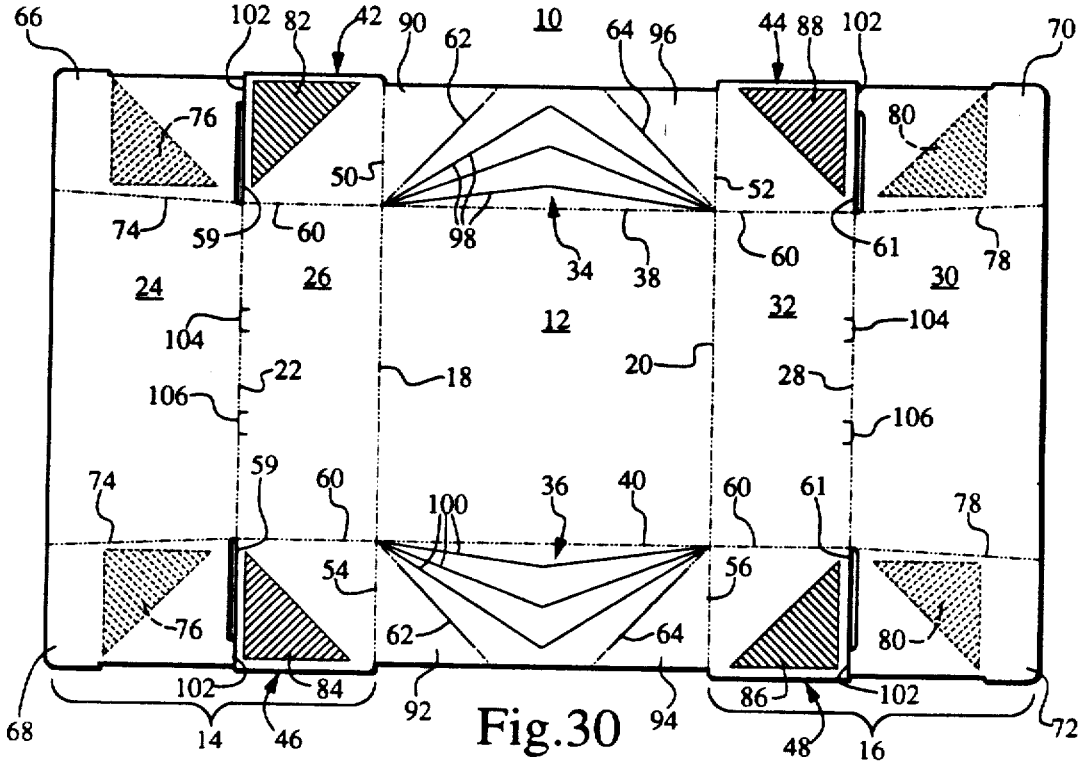
FIG. 30 is a plan view of a modified blank that enables erected trays to be nested one within the other.
Figure 31:
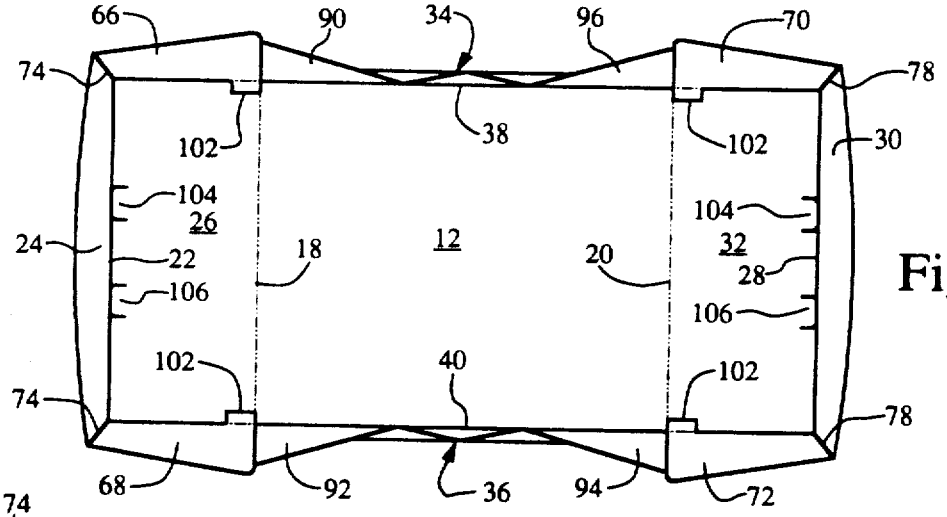
FIG. 31 is a top view of a tray erected from the blank of FIG. 30 and illustrating the tapered ends and sides that allow the rectangular trays to be nested one within the other.
Figure 32:
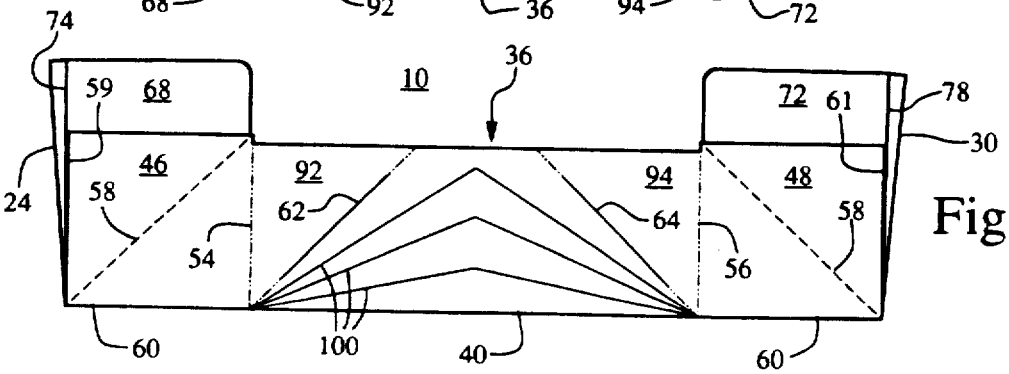
FIG. 32 is a side view of the tray of FIG. 31 illustrating the outward taper of the end walls to enable nesting of the trays.

It is also desirable on occasion to have rectangular type trays that can be nested within each other after set-up to conserve space. This can be accomplished with a blank as shown in FIG. 30. Note in FIG. 30 that the respective score lines 74 at each end of outer section 24 and outer score line 78 on outer wall 30 are tapered outwardly from score lines 22 and 28 respectively. When the carton blank is erected to form the substantially rectangular tray as illustrated in FIG. 1, fold line 74 meets the end 59 of side flaps 42 and 46 and score line 78 meets the end 61 of flaps 44 and 48, causing the outer ends 24 and 30 bow outwardly as shown in FIGS. 31 and 32. Thus, with the side walls and the end walls bowing outwardly, the trays can be nested one within another after they have been formed into their substantially rectangular shape.

It is clear that the type of tray allowing machine pre-setup as illustrated in FIG. 29 can also be nested by having the score lines 74 and 78 formed as illustrated in FIG. 30. The sides 24 and 30 as illustrated in FIGS. 31 and 32 are known as "tapered" sides to allow nesting of the rectangular trays after they have been assembled. Those that are non-nestable have sides that are known as "straight" sides.

Thus it can be seen that the novel inventive paperboard panel is scored such that it can be folded flat for storage, or product placed within the tray and the further folded to form a self-locking, enclosed container for the product erected to form a 4-pointed glued infold tray.

The unique scoring interacts against and with the product to result in a resilient closure which does not require special locks or locking devices. Also it can be folded and unfolded easily which affords the opportunity to easily open the package, fill it with product and close it and then allow the package to be reopened and closed to view the product by the user. The scoring allows a closed tray to be opened and returned to its original shape and content. Further, when the closed box-like container is opened to form the 4-point glued infold tray, additional products, such as french fries, can be added to the tray in the additional holding spaces on each side of the product in the area that was designated as the lid when the carton was closed.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A carton forming a tray of rectangular shape with a bottom wall, vertical end walls, and vertical side walls for receiving a product, the tray being able to be further folded to form a self-locking box-like structure for totally enclosing a product, said box being capable of being unfolded to form the tray and expose the product, the carton comprising:

a rectangular bottom center panel having sides and ends;

a rectangular end panel integrally formed on each end of the bottom center panel and hingedly connected to the center panel by a first score line;

a second score line separating said end panels into outer sections and inner sections;

a continuous side wall, including both a central side wall and end flaps, the central side wall being hingedly connected to each side of the bottom center panel with a third score line;

a side flap hingedly connected to each side of each outer section of each end panel by a fourth score line such that, when each said end panel outer section and its corresponding side flaps and aid continuous side walls are folded upwardly about their respective hinge connections to their vertical position, a rectangular tray is formed with a bottom wall, vertical side walls, and vertical end walls;

glue on one portion of each of said side flaps such that said side flaps may be folded inwardly and glued to the inside of each vertical end flap to form said tray to hold a product;

a corresponding one of said end flaps being hingedly connected by a fifth score line to and forming the outer end of each central side wall, each of said end flaps being hingedly connected by a sixth score line to a corresponding side of said inner section of said end panels, each end flap overlapping and being glued to the outside of a corresponding one of said side flaps to form said tray with vertical end walls and side walls;

a first diagonal score line on each of said central side walls extending upwardly and inwardly from a corresponding junction of said first and third score lines at one end of each of the central side walls to the top of each of said central side walls;

a second diagonal score line on each of said central side walls extending upwardly and inwardly from a corresponding junction of said first and third score lines at the other end of the central side walls to the top of each central side wall such that each rectangular end panel may be folded inwardly about the first score lines to allow the outer sections of the end panels to be folded about the second score lines and to overlap each other and form a box-like structure for enclosing a product;

a first triangular panel formed at one end of a corresponding one of each central side wall by said first diagonal score line and a corresponding one of said fifth score lines;

a second triangular panel formed at the other end of a corresponding one of each central side wall by said second diagonal score line and a corresponding one of said fifth score lines;

said first and second triangular panels being folded outwardly between said side flaps and said central side walls when the inner section and the outer section of each rectangular end panel are folded inwardly about the respective first and second score lines such that a closed box-like structure is formed and pressure against the central side walls by a product in said box-like structure forces said triangular panels toward their folded position, thus providing a box-like structure that self-locks in the closed configuration, the box remaining closed by interaction of the side walls with a product therein; and at least one inverted V-shaped score line in each central side wall between said triangular panels to allow said central side walls to fold around and over a product in said box-like structure.

2. A carton as in claim 1 wherein said side flaps extend above said central side walls in height and are coterminous with said outer sections of said end panels so that when said box-like structure is formed, said outer end sections and corresponding ones of said side flaps overlap to form the box-like structure.

3. A 4-point glued infold tray comprising:

a rectangular bottom center panel having sides and ends;

first and second rectangular end panels each having sides, each one of said end panels being hingedly connected to a respective one of the ends of the bottom center panel by a first score line;

a second score line hingedly separating each said end panel into inner and outer sections, each said outer section forming a vertical end wall of the tray;

vertical side walls hingedly attached to each of the sides of said bottom center panel with a third score line;

a side flap hingedly connected to each side of each outer section of each vertical end wall by a fourth score line;

a vertical end flap hingedly attached to each end of the vertical side walls with a fifth score line and to each side of the inner section of each end panel with a sixth score line to form a tray having a bottom wall, side walls, and end walls;

a diagonal seventh score line in each of said vertical end flaps extending upwardly and inwardly from the junction of said second, fourth, and sixth score lines;

glue attaching the upper portion of each vertical end flap above said diagonal seventh score line to a corresponding one of said side flaps so as to enable said tray to be folded substantially flat for storage;

at least one inverted V-shaped score line in each vertical side wall between said vertical end flaps to allow said vertical side walls to fold around and over a product in said box-like structure;

a diagonal eight score line extending inwardly and upwardly from each junction of the first, third, fifth, and sixth score lines to the top of each of said vertical side walls;

a triangular panel formed at each end of each of the vertical side walls by said fifth score line and said eighth diagonal score line, said triangular panels being foldable inwardly about the fifth score line and outwardly about the diagonal eighth score line to lie between the side flaps and the vertical side walls when each end panel is folded inwardly about its respective first score line such that a closed box-like structure is formed and pressure against the side walls by a product in said box-like structure forces the triangular panels toward their inwardly folded position, thus providing a box-like structure that self-locks in the closed configuration; and wherein said side flaps extend above said central side walls in height and are coterminous with the sides of said outer end sections of said end panels such that when said box-like structure is formed, said outer end sections and said side flaps overlap to form the box-like structure.

* * * * *